US005475482A

United States Patent [19]

Ishiguro

[11] Patent Number: 5,475,482

[45] Date of Patent: Dec. 12, 1995

[54] FIXING DEVICE HAVING SELF LOADING MECHANISM AND IMAGE FORMING APPARATUS USING THE SAME

[75] Inventor: Toshitsugu Ishiguro, Shizuoka, Japan

[73] Assignee: Tokyo Kenki Kabushiki Kaisha, Tokyo, Japan

[21] Appl. No.: 267,370

[22] Filed: Jun. 29, 1994

[30] Foreign Application Priority Data

Jul. 6, 1993 [JP] Japan ..... 5-166594

[51] Int. Cl.[6] ..... G03G 15/22; G03G 15/20

[52] U.S. Cl. ..... 355/283; 355/282

[58] Field of Search ..... 355/283, 282, 355/296; 118/652; 15/256.51, 256.52, 256.53

[56] References Cited

U.S. PATENT DOCUMENTS

| | | | |
|---|---|---|---|
| 3,980,423 | 9/1976 | Latone | 15/256.52 X |
| 4,324,482 | 4/1982 | Szlucha . | |
| 5,201,852 | 4/1993 | Ogoshi | 355/283 X |
| 5,275,104 | 1/1994 | Corrado et al. | 15/256.53 X |

FOREIGN PATENT DOCUMENTS

| | | | |
|---|---|---|---|
| 58-42464 | 9/1983 | Japan . | |
| 60-108871 | 6/1985 | Japan | 355/283 |
| 61-166574 | 7/1986 | Japan | 355/283 |
| 1-232375 | 9/1989 | Japan | 355/283 |
| 2-144587 | 6/1990 | Japan | 355/283 |
| 5-53471 | 3/1993 | Japan | 355/283 |

OTHER PUBLICATIONS

Patent Abstracts of Japan, vol. 14, No. 150, 22 Mar. 1990.

Patent Abstracts of Japan, vol. 14, No. 398, 28 Aug. 1990.

Patent Abstracts of Japan, vol. 7, No. 67, 19 Mar. 1983.

Korsch et al., "Fuser Hot Roll Sensor Strip Cleaner and Roughener", IBM Technical Disclosure Bulletin, vol. 25, No. 38, Aug. 1982. pp. 1355–1356.

*Primary Examiner*—Matthew S. Smith

*Attorney, Agent, or Firm*—Cushman, Darby & Cushman

[57] ABSTRACT

A fixing device includes fixing and pressure rollers rotatably supported by the frame, and a compressible cleaning pad supported by the holder, which is inserted into and engaged with the frame. The cleaning pad is in contact with the fixing surface of the fixing roller such that the cleaning pad is not compressed when the fixing roller is not rotated and is compressed to effect the cleaning operation when the fixing roller is rotated.

19 Claims, 4 Drawing Sheets

FIXING DEVICE HAVING SELF LOADING MECHANISM AND IMAGE FORMING APPARATUS USING THE SAME

BACKGROUND OF THE INVENTION

1. Field of the Invention

This invention relates, in general, to fixing devices. In particular, the invention relates to a fixing device, which is used in an image forming apparatus to fix a toner image on a paper sheet, including a fixing roller, a pressure roller engaged with the fixing roller and a cleaning pad which is in contact with the surface of the fixing roller to clean the surface of the roller.

2. Description of the Related Art

As is well known, a conventional image forming apparatus, e.g., electro-photo copying machines, laser beam printers, etc., typically includes an image forming unit for forming an image on an image carrier, a developing unit for developing the image, as a visible image, on the image carrier by a toner powder, and a transfer unit for transferring the developed image formed on the image carrier to a paper sheet. The image forming apparatus also includes a fixing unit which fuses the toner powder (developed image) on the paper sheet and fixes the fused toner on the paper sheet as a fixed image.

A conventional fixing unit is shown in FIG. 1. A fixing unit 11 includes a cylindrical fixing roller (heat roller) 13 in which a heater (not shown) is provided at a center portion along a length thereof. Each side of fixing roller 13 is rotatably supported by a suitable bearing means, respectively, and thus, fixing roller 13 is rotated in counterclockwise by a motor (not shown). A pressure roller 15 is located below fixing roller 13 such that it is forcibly engaged with the surface of fixing roller 13 by a spring (not shown). Thus, pressure roller 15 is rotated in clockwise when fixing roller 13 is rotated as described above. As shown in FIG. 1, those rollers 13 and 15 are rotatably located in a housing 17. A lead-in opening 17*a* is opened in one side wall of housing 17 to introduce a paper sheet P into housing 17 and a lead-out opening 17*b* is also opened in the opposite side wall to discharge paper sheet P from housing 17. A cleaning unit 18 is slidably fitted in an opening 21 formed in the upper wall of housing 17. Cleaning unit 18 has a cleaning pad 19 therein. One end of pad 19 is in contact with the surface of fixing roller 13 at a prescribed pressure by a suitable pressing means, e.g., a leaf spring 23. One end of leaf spring 23 is fixed to an upper openable cover 25 of an image forming apparatus and the other end is in contact with cleaning unit 18 to urge cleaning pad 19 on the surface of fixing roller 13. Leaf spring 23 has relatively a long length to easily regulate the pressure on cleaning pad 19. Cleaning pad 19 is always urged on the surface of fixing roller 13 under the prescribed pressure.

A paper sheet P on which a developed toner image has been transferred is led into fixing unit 11 (housing 17) through lead-in opening 17*a*. When paper sheet P passes through the contact portion between fixing roller 13 and pressure roller 15, the toner on paper sheet P is fused by heat and pressure generated by rollers 13 and 15 and is fixed on paper sheet P as a fixed image. In this fixing operation, almost all fused toner is fixed on paper sheet P, but a part of fused toner on the surface of paper sheet P may be transferred to the circumferential surface of fixing roller 13. The transferred toner on fixing roller 13 is removed by cleaning pad 19.

Presently, there is a tendency to minimize the external size of an image forming apparatus. Thus, a compact size, in particular a reduced height of the fixing unit is desired to achieve a reduced external size of the image forming apparatus.

In the conventional fixing unit having the above-described construction, it may be difficult to reduce the height of the unit because of the leaf spring. If the length of leaf spring 23 is reduced, regulation of pressure generated by leaf spring 23 may be difficult. Pressure by leaf spring 23 is applied in excess to cleaning pad 19 resulting in the reduction of durability of cleaning pad 19. Otherwise, insufficient cleaning by cleaning pad 19 may occur. Since cleaning pad 19 of the conventional fixing unit is always urged on the surface of fixing roller 13 at a prescribed pressure, cleaning pad 13 might be deformed. Therefore, the service life of cleaning pad 23 is shortened.

SUMMARY OF THE INVENTION

Accordingly, it is an object of the present invention to reduce the height of a fixing device as compared with conventional fixing devices.

It is another object of the invention to provide a unique self loading mechanism of a cleaning pad used in a fixing device.

It is still another object of the invention to reduce components of a fixing device.

It is still another object of the invention to achieve a reduction in height of an image forming apparatus as compared with conventional image forming apparatus.

To accomplish the above-described objects, a fixing device includes a rotatable fixing unit for fixing a toner on a medium, a compressible cleaning unit, contacting with a portion of the fixing surface of the fixing unit, for cleaning the fixing surface of the fixing unit, and a loading mechanism for compressing the cleaning unit to effect the cleaning operation only while the fixing unit is rotated.

BRIEF DESCRIPTION OF THE DRAWINGS

These and other objects and advantages of this invention will become apparent and more readily appreciated from the following detailed description of the presently preferred exemplary embodiments of the invention taken in conjunction with the accompanying drawings wherein.

DETAILED DESCRIPTION OF THE PREFERRED EMBODIMENT

Figure 1:
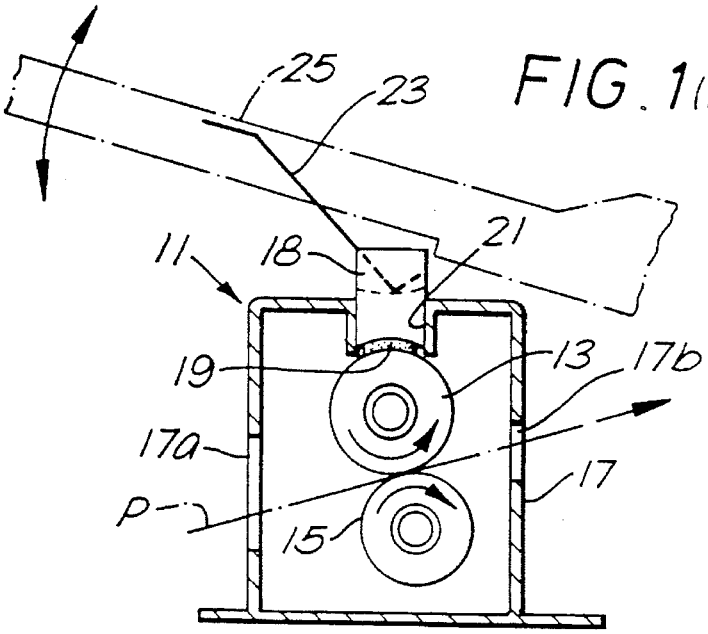
FIG. 1 (PRIOR ART)
FIG. 1 is a schematic view illustrating a conventional fixing device.

Preferred embodiment of the present invention will be described in more detail with reference to the accompanying drawings. However, the same numerals are applied to the similar elements in the drawings, and therefore, the detailed descriptions thereof are not repeated.

An embodiment of the present invention will now be described with reference to FIG. 2 through FIG. 7. In the embodiment, a fixing device of the present invention is applied to a well known laser beam printer.

Figure 2:
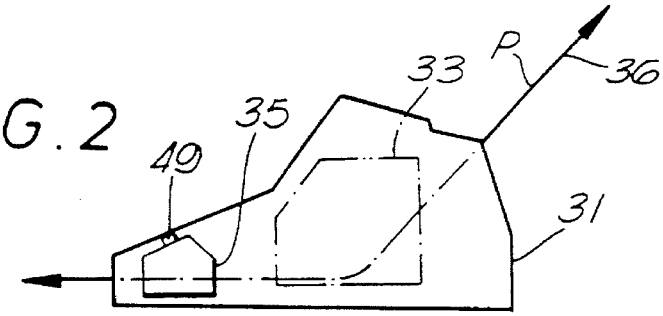
FIG. 2 is a schematic side view illustrating a printer including a fixing device of one embodiment of the present invention.

As shown in FIG. 2, a laser beam printer 31 includes an image forming unit 33 and a fixing device 35. Image forming unit 33 typically includes an image carrier, a charger, a laser beam exposure device, a developing device and a transfer device. The image forming unit 33 may include a cleaning device, if needed. Respective devices of image forming unit 33 are well known in the art, and therefore they are not shown in FIG. 2 for the purpose of simplicity. A detailed operation of each device of image forming unit 33 also is not described. In FIG. 2, image forming unit 33 forms a latent image on the image carrier by the laser beam exposure device and develops the latent image, as a toner image, by the developing device. Image forming device 33 transfers the toner image by the transfer device from the image carrier to a paper sheet P fed from a paper tray 36. Then, paper sheet P on which the toner image is transferred is further fed to fixing device 35. The toner image is fixed on paper sheet P by fixing device 35 and paper sheet P is then discharged from laser beam printer 31.

Figure 3:
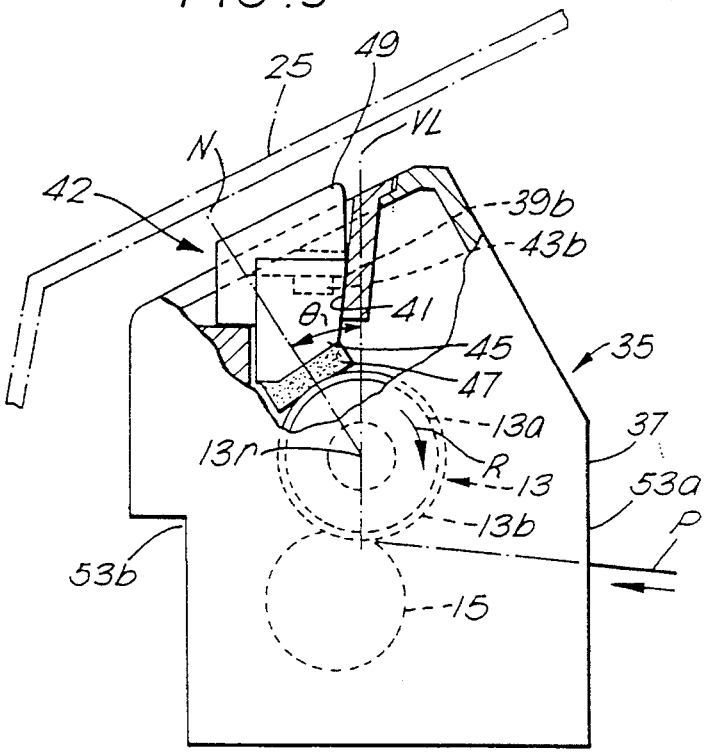
FIG. 3 is an enlarged and partly sectional schematic view of the fixing device shown in FIG. 2.
Figure 4:
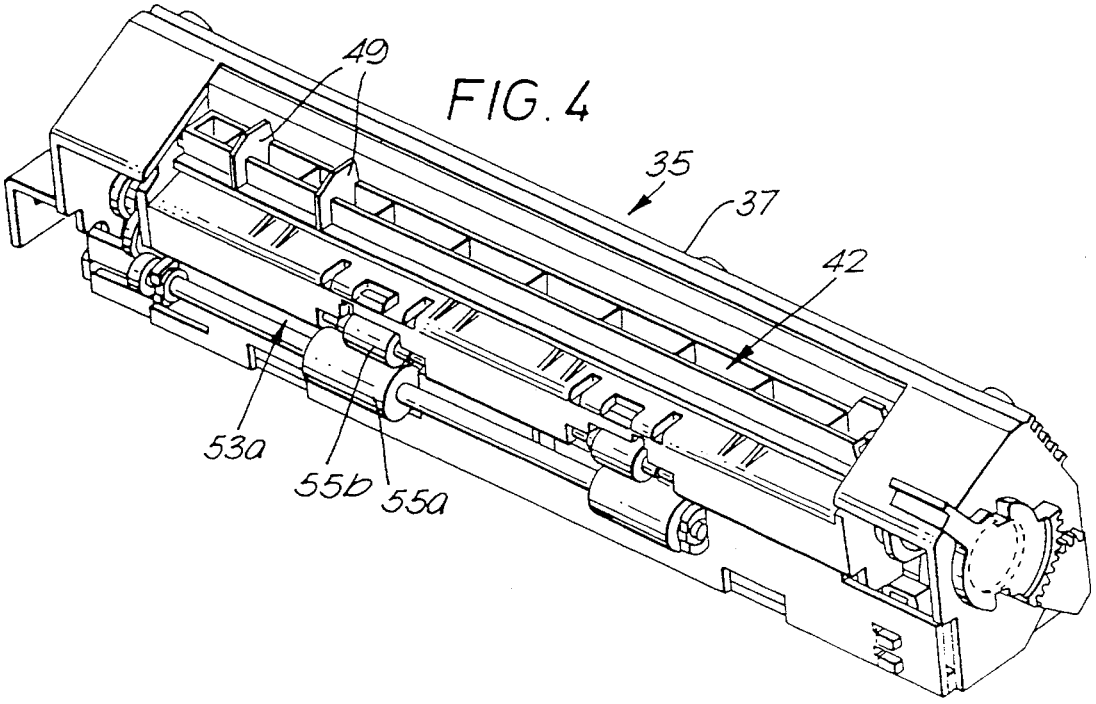
FIG. 4 is an enlarged perspective view illustrating the fixing device shown in FIG. 2.
Figure 5:
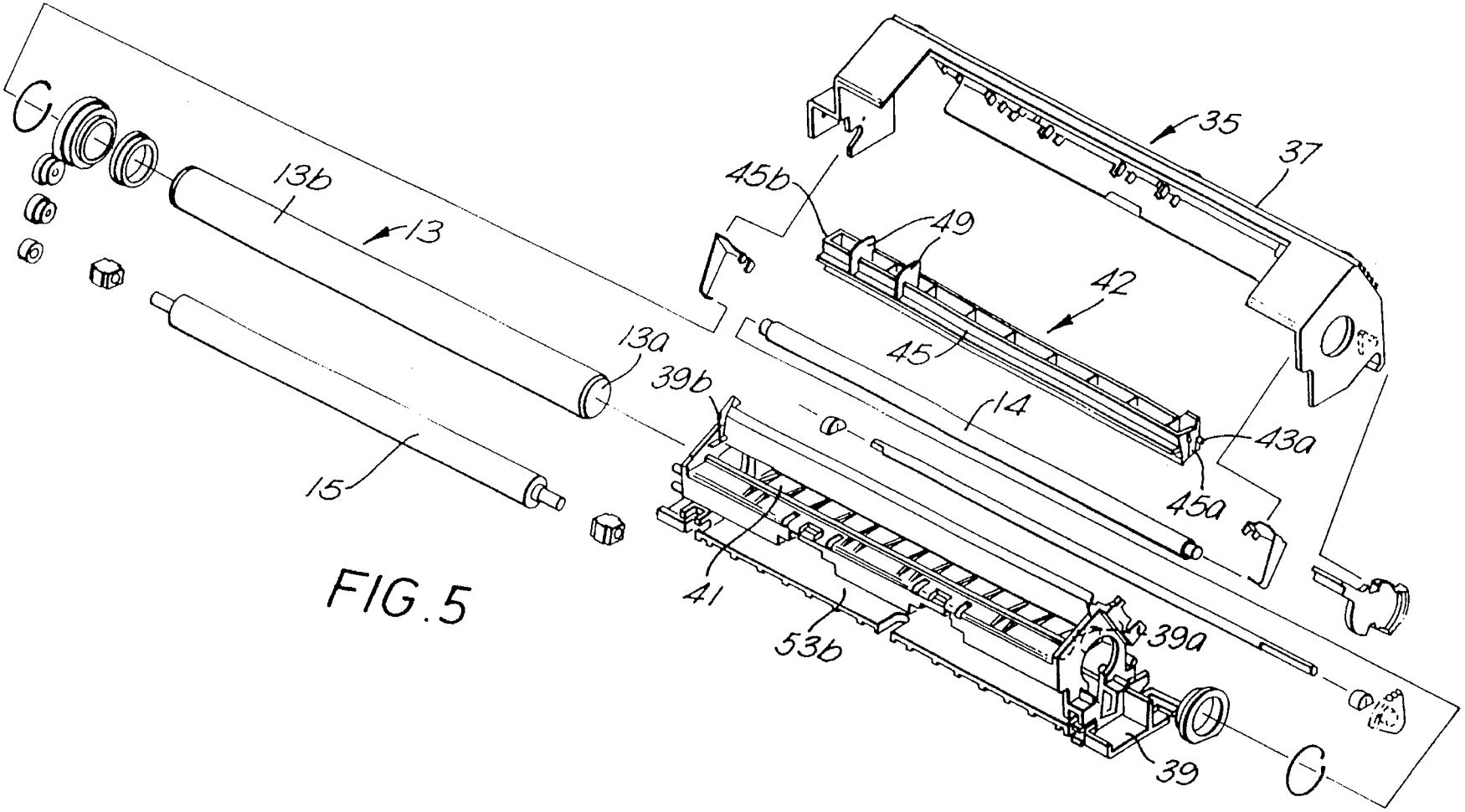
FIG. 5 is an exploded view of the fixing device shown in FIG. 4.

A detail construction of fixing device 35 will be described by referring FIGS. 3, 4, 5 and 6. As shown in FIGS. 3 and 5, a fixing roller 13 is disposed in a housing 37 of fixing device 35 and rotatably supported by a frame 39 shown in FIG. 5. Fixing roller 13 includes an elongated metallic hollow sleeve 13*a* in which a heating lamp 14 is disposed, as a heating source, along the axial direction thereof. Other heating source may be located in sleeve 13*a*, instead of the heating lamp. A circumferential surface of sleeve 13*a* is provided with a silicon rubber layer 13*b* which acts as a fixing surface. A pressure roller 15 is also rotatably supported by frame 39 so that the circumferential surface of pressure roller 15 is forcibly engaged with the surface of fixing roller 13, as shown in FIG. 3. Thus, pressure roller 15 is dependently rotated as fixing roller 13 is rotated by a suitable driving source, e.g., motor, in a direction indicated by an arrow R. As shown in FIG. 3 and 5, an elongated opening 41 through which a cleaning unit 42 is inserted is provided in frame 39. Opening 41 is formed so that it is located at a portion offset by a prescribed amount from the perpendicular line VL passing through the rotational center 13*r* of fixing roller 13. As can be seen in FIG. 3, opening 41 is offset to the paper lead-out side of fixing roller 13. A pair of inner projections 39*a* and 39*b* is formed at opposite inner sides of frame 39 to engage with a pair of short projections 43*a* and 43*b* formed at opposite side walls 45*a* and 45*b* of an elongated holder 45 of cleaning unit 42, respectively.

Figure 6:
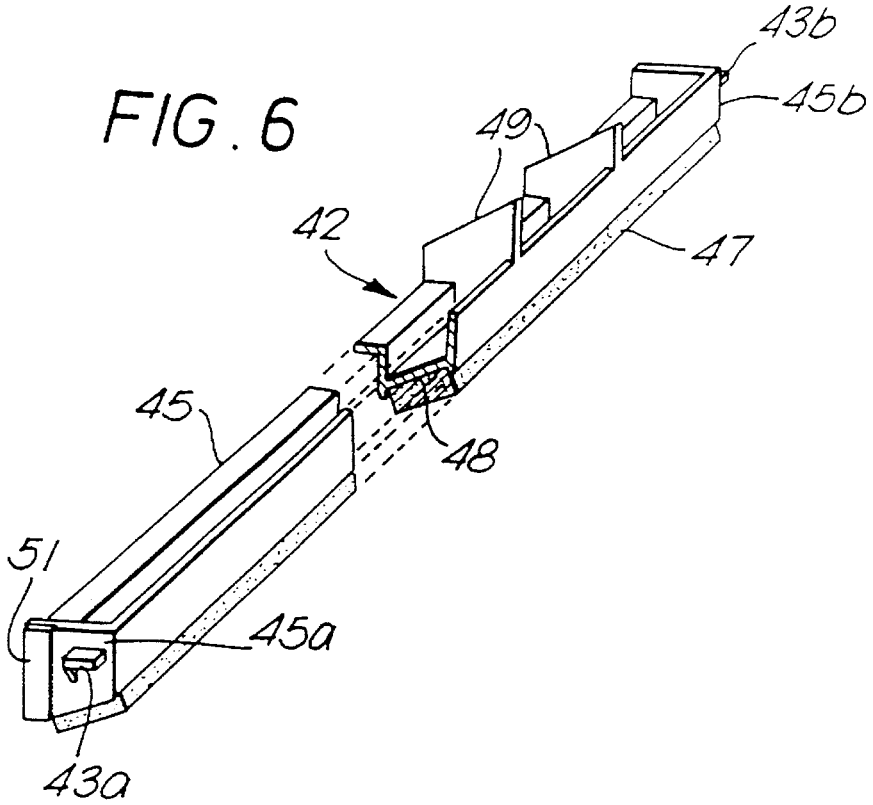
FIG. 6 is an enlarged perspective view of a cleaning unit of fixing device shown in FIGS. 4 and 5.

As can be seen in FIG. 6, a plate shaped elongated and compressible cleaning pad 47 made of felt is firmly supported by holder 45. A lower surface of holder 45 to be opposite to the surface of fixing roller 13 is slanted and a recess 48 is formed therein. One surface of cleaning pad 47 may be grooved into recess 48 and fixed on the lower surface of holder 45 with a suitable adhesive. Thus, the other surface of cleaning pad 47 is also slanted against the horizontal level.

A pair of handles 49 projects from an upper surface of holder 45 to easily insert holder 45 into opening 41 of frame 39. The pair of handles 49 is located at an off-center portion of holder 45 near side wall 45*b*. A leaf plate 51 one end of which is fixed to side wall 45*a* of holder 45 is extended along the side wall 45*a* to generate a suitable resilient force. Leaf plate 51 with a suitable resilient force prevents holder 45 from undesirable moving and maintains the engagement between holder 45 and frame 39 when holder 45 is located at a prescribed position in opening 41.

As similar to the conventional fixing device shown in FIG. 1, a paper lead-in side 53*a* and a paper lead-out side 53*b* is defined in the corresponding front and rear sides of frame 39 (fixing device 35), respectively. A pair of paper feed roller units 55*a* and 55*b* is rotatably disposed at paper lead-in side 53*a* of fixing device 35, as shown in FIG. 4.

A conventional temperature detectors (thermistor, thermostat and thermal fuse) are also provided in fixing device 35 to detect temperature of fixing roller 13. Undesirable temperature rise of fixing roller 13 is avoided by the detectors.

When cleaning unit 42 is inserted into opening 41 of fixing device 35, an operator pinches the pair of handles 49 and inserts it into opening 41. Firstly, one of the short projections 43*a* of side wall 45*a* is inserted below the rear surface of inner projection 39*a*. Then, holder 45 is rotated around the engaged portion of projection 43*a* and inner projection 39*a* so that the other end of holder 45 is inserted into opening 41. The other short projection 43*b* of side wall 45*b* is also inserted below the rear surface of the corresponding inner projection 39*b*. As shown in FIGS. 3 and 4, the other surface of cleaning pad 47 is in contact with the circumferential surface of fixing roller 13 by the gravity of cleaning unit 42 and holder 45 is located at the prescribed position in opening 41.

In more detail, the other surface of cleaning pad 47 is in contact with a portion of the surface of fixing roller 13 located on an ideal line N, passing through rotational center 13*r* of fixing roller 13, which has a prescribed angle, e.g., 33, against perpendicular line VL in a counter clockwise direction in FIG. 3. In addition, holder 45 is engaged with the inner surface of frame 39 at a down stream side from the contacting portion between cleaning pad 47 and fixing roller 13 in a rotational direction (clockwise direction) of fixing roller 13 indicated by an arrow R. Ideal line N and the surface of cleaning pad 47 is intersected with each other at substantially right angles so that the contact area between cleaning pad 47 and the surface of fixing roller 13 is maximized. Thus, toner remaining on the surface of fixing roller 13 is effectively removed by cleaning pad 47. In this position, undesirable movement of holder 45 is avoided by the resilient force of leaf plate 51 of holder 45, which is engaged with the top of inner projection 39*a*. The engagement between holder 45 and frame 39 is also maintained. In this state, holder 45 and frame 39 may be loosely engaged with one the other when fixing roller 13 is not rotated.

In the above-described construction, the extending end of the pair of handles 49 of holder 45 may be formed obliquely in conformity with the shape of an upper cover of the apparatus.

A theory of operation of the above-described fixing device 35 will now be described with reference to FIG. 7.

Figure 7:
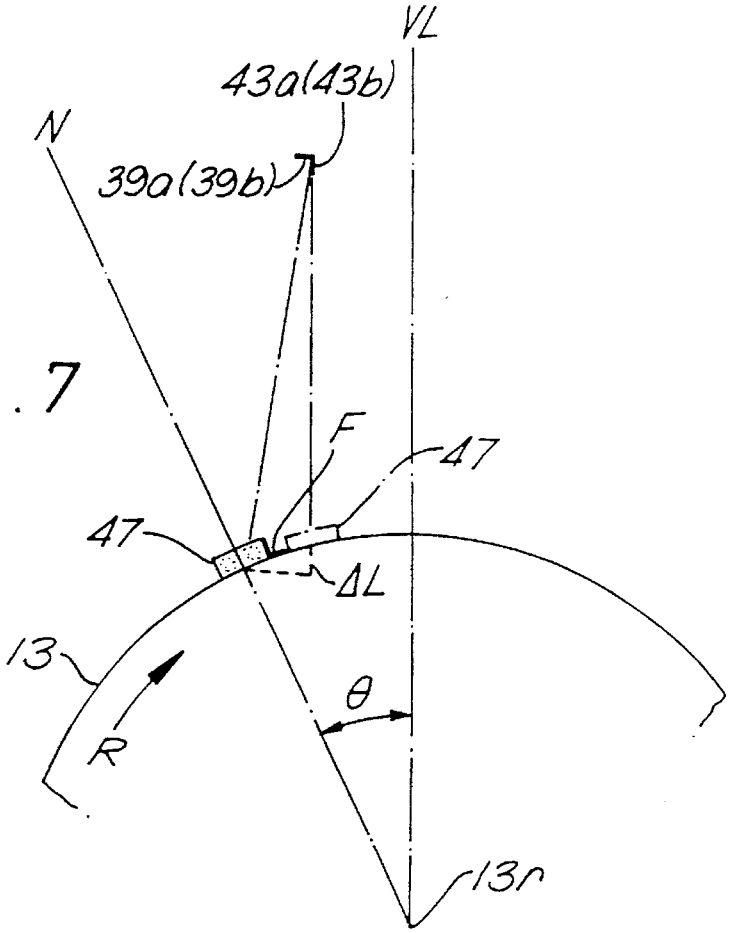
FIG. 7 is a view illustrating the operational idea of the cleaning unit of the fixing device shown in FIG. 3.

In a first position indicated by a solid line in FIG. 7, cleaning pad 47 is not compressed and thus the cleaning operation is not effected. When fixing roller 13 is rotated by a motor (not shown) in the direction indicated by an arrow R, cleaning pad 47 of cleaning unit 42 is urged by a frictional force F generated between the surface of fixing roller 13 and cleaning pad 47 toward the rotational direction R of fixing roller 13. Cleaning pad 47 is rotated around the pair of inner projections 39*a* and 39*b* of frame 39 where the pair of short projections 43*a* and 43*b* of holder 45 is engaged with the pair of inner projections 39*a* and 39*b*, respectively. Cleaning pad 47 is sagged and deformed and is moved along the surface of fixing roller 13 to a second position as indicated by a phantom line in FIG. 7. Thus, cleaning pad 47 is compressed by a contracted amount L and presses the surface of fixing roller by an elastic restoring force thereof corresponding to the contracted amount L. The cleaning operation is effected and the remaining toner particles on the surface of fixing roller 13 are effectively removed by cleaning pad 47 at the second position.

The pair of inner projections 39*a* and 39*b*, the pair of short projections 43*a* and 43*b*, the slanted surface of cleaning pad 47 and the rotation of fixing roller 13 act as a loading means, which moves cleaning pad 47 to a cleaning position (second position) when fixing roller 13 is driven.

With the above-described embodiment, cleaning pad 47 is pressed on the surface of fixing roller 13 by a sufficient force (elastic restoring force) at the second position without the use of external urging means such as a leaf spring, and thus, the toner particle remaining on the surface of fixing roller 13 is removed smoothly. Since cleaning pad 47 is in contact with a portion of the surface of fixing roller 13 lower than the upper-most portion of fixing roller 13 because of its construction feature, an overall height of fixing device 35 may be lowered. In addition, since cleaning pad 47 is loaded only while fixing roller 13 is rotated, the excessive deformation of cleaning pad 47 is avoided during the service period, and thus a service life of cleaning pad 47 is extended.

Figure 8:
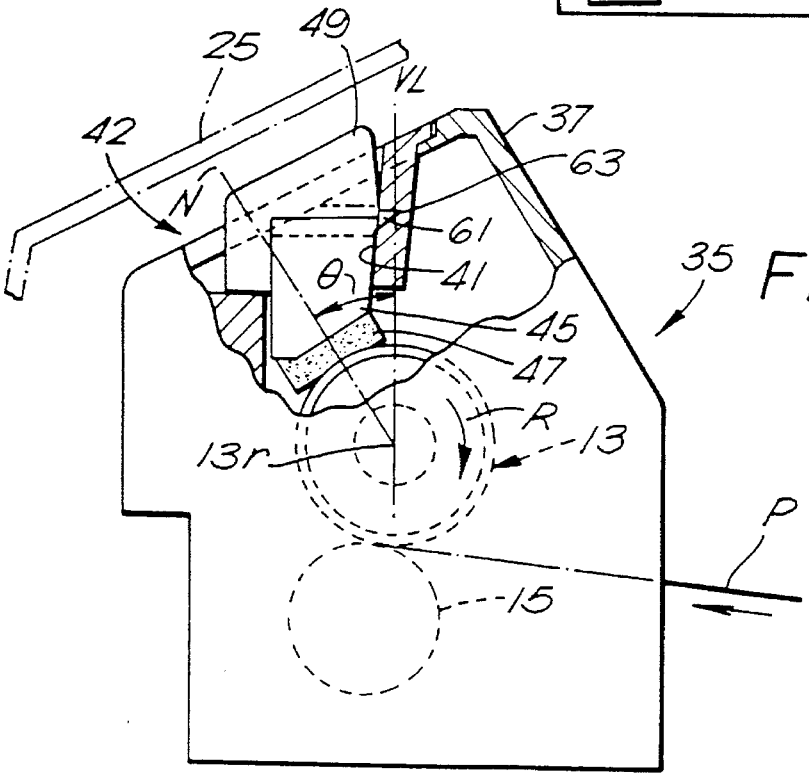
FIG. 8 is a schematic view illustrating a modification of a fixing device of the present invention.

In the above-described embodiment, the pair of short projections 43*a* and 43*b* is formed on holder 45 and the pair of inner projections 39*a* and 39*b* is formed on frame 39. As shown in FIG. 8, however, holder 45 may be provided with a short projection 61 at the rear wall portion, instead of the pair of short projections 43*a* and 43*b*, and frame 39 may be provided with a depression 63, instead of the pair of inner projections 39*a* and 39*b*, to be engaged with short projection 61.

According to the present invention, since external urging means such as a leaf spring is not needed in the invention, an overall height of the fixing device is reduced as compared with conventional fixing devices and service life of the cleaning pad is also extended.

The present invention has been described with respect to a specific embodiment. However, other embodiments based on the principles of the present invention should be obvious to those of ordinary skill in the art. Such embodiments are intended to be covered by the claims.

What is claimed is:

1. A fixing device which receives a medium on which a toner is supported, comprising:

rotatable fixing means the fixing the toner on the medium, the fixing means having a cylindrical fixing surface which is subject to transfer of part of the toner; and compressible cleaning means, contacting with a portion of the fixing surface of the fixing means, for cleaning the transferred toner on the fixing surface of the fixing means, the cleaning means being caused to compress to effect a cleaning operation only while the fixing means is rotated.

2. A device according to claim 1, wherein the fixing means has a fixing roller, a pressure roller and a frame which rotatably supports the fixing and pressure rollers therein, and the cleaning means includes a cleaning pad, a holder which supports the cleaning pad thereon, and means for engaging with the frame when the holder is located in the frame.

3. A device according to claim 1, wherein the cleaning means is caused to compress by rotation of the fixing means.

4. A fixing device which receives a medium on which a toner is supported, comprising:

means for fixing the toner on the medium, the fixing means having a cylindrical fixing surface which is subject to transfer of a part of the toner;

compressible cleaning means for cleaning the transferred toner on the cylindrical fixing surface of the fixing means, the cleaning means being located at a first position on the fixing surface at which the cleaning means is not substantially compressed when the fixing means is not activated; and loading means for moving the cleaning means from the first position to a second position on the fixing surface at which the cleaning means is compressed to effect a cleaning operation when the fixing means is activated.

5. A device according to claim 4, wherein the fixing means includes an elongated fixing roller having the fixing surface and an elongated pressure roller forcibly contacting with the fixing surface of the fixing roller, the elongated fixing roller having a heating source.

6. A device according to claim 5, wherein the fixing means includes a frame by which the fixing roller and the pressure roller are rotatably supported and the cleaning means includes a holder and a compressible cleaning pad supported by the holder, the cleaning pad being in contact with the fixing surface of the fixing roller and the holder being engaged with the frame during the activation of the fixing means.

7. A device according to claim 6, wherein the loading means includes means for rotating the fixing roller, the cleaning pad is not substantially compressed when the fixing roller is not rotated, and the cleaning pad is compressed when the fixing roller is rotated.

8. A device according to claim 6, wherein the frame has a medium lead-in side and a medium lead-out side, and the fixing means is provided with a medium conveying path from the medium lead-in side to the medium lead-out side through a contacting portion of the fixing roller and the pressure roller, the first and second positions being respectively defined on the fixing surface of the fixing roller offset by a prescribed amount toward the medium lead-out side from a perpendicular line passing through the rotational center of the fixing roller.

9. A device according to claim 5, wherein the fixing means includes a frame by which the fixing roller and the pressure roller are rotatably supported.

10. A device according to claim 9, wherein the frame includes an opening at a location offset by a prescribed amount from a perpendicular line passing through the rotational center of the fixing roller.

11. A device according to claim 10, wherein the cleaning means has an elongated holder and a compressible cleaning pad which is supported by the holder, the loading means including means for rotating the fixing roller, engaging means for performing an engagement between the frame and the holder when the holder is located in the opening of the frame and an inclined surface of the cleaning pad.

12. A device according to claim 11, wherein the engaging means includes a pair of projections respectively formed at opposite elongated ends of the holder and the frame includes a pair of engaging portions exposed to the opening.

13. A fixing device which receives a medium on which a toner is supported, comprising:

a frame;

an elongated fixing roller, having a rotational center, rotatably supported by the frame;

an elongated pressure roller rotatably supported by the frame and forcibly engaged with the fixing roller to carry out a fixing operation in which the toner on the medium is fixed;

an elongated cleaning holder, having an inclined elongated surface, detachably located in the frame;

a compressible cleaning pad supported by the inclined elongated surface of the cleaning holder so that a surface of the compressible cleaning pad is slanted, the surface of the compressible cleaning pad being in contact with a portion of a surface of the fixing roller offset by a prescribed amount from a perpendicular line passing through the rotational center of the fixing roller; and engaging means for performing an engagement of the cleaning holder and the frame when the cleaning holder is located at a predetermined position in the frame.

14. A device according to claim 13 further including loading means, associated with the engaging means, for forcibly compressing the compressible cleaning pad when the fixing operation is effected.

15. A device according to claim 14, wherein the engaging means includes a pair of projections respectively formed at opposite elongated ends of the cleaning holder and the frame includes a pair of engaging portions corresponding to the pair of projections.

16. A device according to claim 15, wherein the cleaning holder includes means for maintaining the engagement of the cleaning holder and the frame.

17. A device according to claim 16, wherein the maintaining means includes a leaf plate one end of which is fixed to one of the elongated ends of the cleaning holder so that the cleaning holder is urged in an elongated direction by the leaf plate when the cleaning holder is located in the frame.

18. A device according to claim 13, wherein the engaging means includes a projection at a side of the cleaning holder perpendicular to the elongated direction of the cleaning holder and a corresponding engaging portion of the frame.

19. An image forming apparatus comprising:

image forming means for forming an image on a medium, as a toner image, by using a toner;

a frame;

an elongated fixing roller, having a rotational center, rotatably supported by the frame;

an elongated pressure roller rotatably supported by the frame and forcibly engaged with the fixing roller to carry out a fixing operation in which the toner image is fixed on the medium;

an elongated cleaning holder, having an inclined elongated surface, detachably inserted in the frame;

a compressible cleaning pad supported by the inclined elongated surface of the cleaning holder so that a surface of the compressible cleaning pad is slanted, the surface of the compressible cleaning pad being in contact with a portion of a surface of the fixing roller offset by a prescribed amount from a perpendicular line passing through the rotational center of the fixing roller; and engaging means for performing an engagement of the cleaning holder and the frame when the holder is located at a predetermined position in the frame.

* * * * *

UNITED STATES PATENT AND TRADEMARK OFFICE

CERTIFICATE OF CORRECTION

| | | |
|---|---|---|
| PATENT NO. | : | 5,475,482 |
| DATED | : | December 12, 1995 |
| INVENTOR(S) | : | ISHIGURO |

It is certified that error appears in the above-identified patent and that said Letters Patent is hereby corrected as shown below:

ON THE COVER PAGE:

[73] Assignee: Tokyo Kenki Kabushiki Kaisha, Tokyo, Japan

Should Read: [73] Assignee: Tokyo Denki Kabushiki Kaisha, Tokyo, Japan

Signed and Sealed this

Thirtieth Day of April, 1996

*Attest:*

*Attesting Officer*

BRUCE LEHMAN

*Commissioner of Patents and Trademarks*